United States Patent [19]

Bryant

[11] 4,039,218

[45] Aug. 2, 1977

[54] CLUTCH PADS

[76] Inventor: John G. Bryant, 15 Ridgewood Road, Radnor, Pa. 19087

[21] Appl. No.: 295,206

[22] Filed: Oct. 5, 1972

[51] Int. Cl.[2] ..... B66C 1/12

[52] U.S. Cl. ..... 294/74

[58] Field of Search ..... 294/74, 75, 76, 78 R; 224/49

[56] References Cited

U.S. PATENT DOCUMENTS

| | | | |
|---|---|---|---|
| 2,567,872 | 9/1951 | Burke | 294/74 X |
| 3,317,233 | 5/1967 | Black | 294/74 |
| 3,425,737 | 2/1969 | Sutton | 294/74 |
| Re. 26,704 | 11/1969 | Norton | 294/74 |

OTHER PUBLICATIONS

Wear-Flex Corporation Publication (1-1-66), with regard to U.S. Patent No. 3,290,083.

*Primary Examiner*—Johnny D. Cherry
*Attorney, Agent, or Firm*—Frederick J. Olsson

[57] ABSTRACT

Pad devices disposed between a lift sling and a load. The pad permitting relative sliding motion between the load and the sling without the sling and the load being in direct contact. This avoids damage to the sling and/or the load during the lift.

16 Claims, 12 Drawing Figures

CLUTCH PADS

The invention relates to overhead materials handling equipment and more particularly relates to improvements in clutch pads of the kind disclosed in my co-pending application, Ser. No. 204,932, filed Dec. 6, 1971 and entitled CLUTCH PADS.

Clutch pads of the kind shown in my co-pending application are of the type tied to the sling with straps in position for the desired engagement with the load to be lifted. In most applications, the pad is not permanently secured to the sling. The clutch pads herein are constructed in the form of a sleeve which surrounds and grips the sling and is positioned by sliding along the sling. The pads are essentially a permanent part of the sling, but may be removed if desired.

One of the subjects of the invention is to provide a sleeve-type clutch pad of the kind in question comprising telescoping sleeves, having a symmetrical construction providing for either side of the pad to be employed for lifting and thereby increase the effective life of the pad.

Another object of the invention is to provide a sleeve-type clutch pad which when mounted surrounds and grips the sling and which has a symmetrical construction so that the pad can be rotated to different angular positions to bring different portions of the pad in contact with the load in the sling to thereby increase the effective life of the sling.

Another object of the invention is to provide a sleeve-type clutch pad of the kind in question constructed of thin, light weight, stretchable, flexible material formed into a pad of tubular shape, the flexible stretchable characteristic permitting the pad to be manually opened up so that it can be drawn over the eye of the sling and upon release to grip the body of the sling to maintain the pad in position, but which permits the pad to be adjusted along the sling in a location for contacting the load.

The preferred forms of the invention will be described below in connection with the following drawings therein:

FIG. 1 is an exploded perspective view of a pad constructed in accordance with the invention and especially suitable for use with the band-type sling;

FIG. 1*a* is a sectional view of a modified pad of the kind of FIG. 1.

Figure 1:
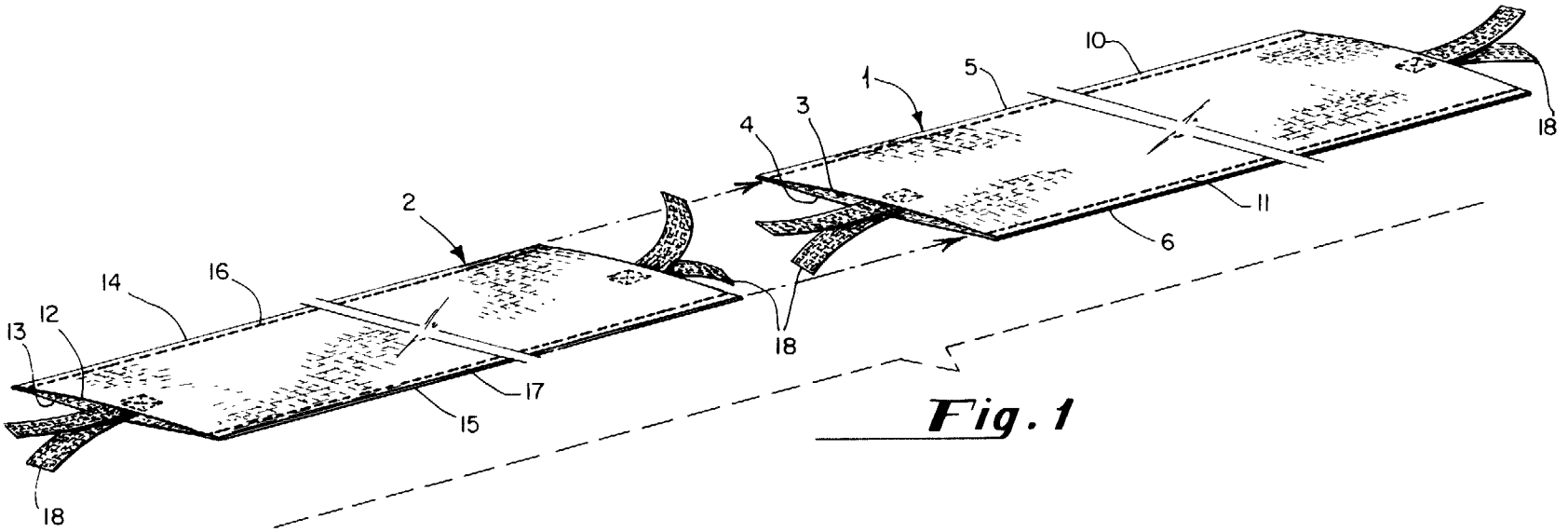
Figure 2:
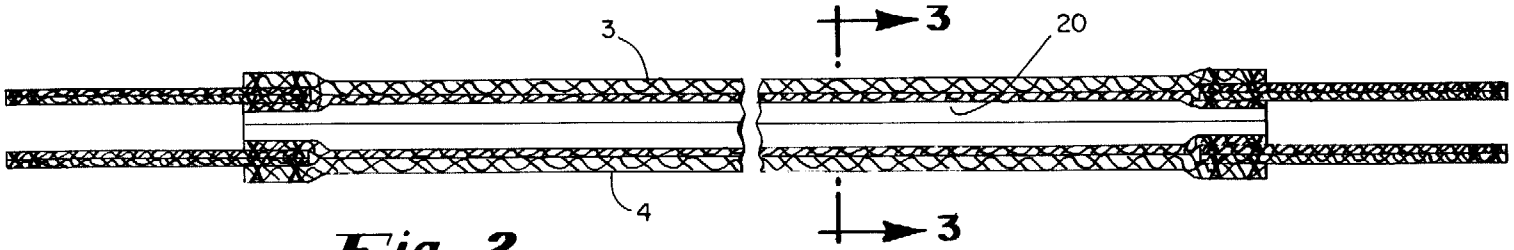
FIG. 2 is a longitudinal sectional, elevational view of the pad of FIG. 1.

In FIG. 1 the clutch pad includes the outer sleve 1 for engaging the load and the inner sleeve 2 for engaging the sling. When engaged with a sling and a load, the pad maintains the same out of direct contact. The inner sleeve is dimensioned so that it fits inside of the outer sleeve as is shown in FIGS. 2 and 3.

The outer sleeve includes a pair of overlying ply sections 3 and 4. The opposite edges 5 and 6 of the ply sections are fixedly connected together as by the stitches 10 and 11.

The inner sleeve includes a pair of overlying ply sections 12 and 13. The opposite edges 14 and 15 of which are fixedly connected together as by stitches 16 and 17.

Figure 3:
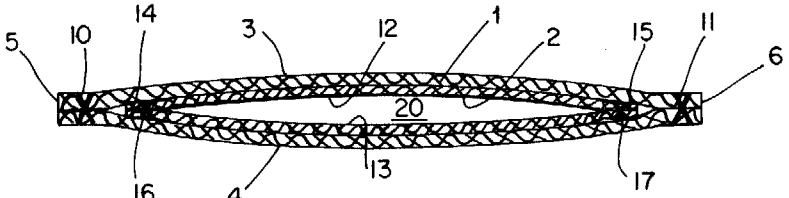
FIG. 3 is a sectional view taken aong the lines 3—3 of FIG. 2.

As indicated by FIG. 3 the inner and outer sleeves make a close fit. The fit provides for the sleeves to be relatively slidable in a longitudinal direction. The tabs 18 can be tied/stitched together to ensure the sleeve will remain together when the pad is not in use.

The pad of FIG. 1 is mounted on a sling by virtue of the channel 20 formed by the inner sleeve. The pad is mounted simply by threading an eye of the sling throgh the channel 20 and then pulling through the sling body. The inner sleeve is dimensioned so that it makes a sliding fit with the sling when not under load. In this way, the pad is maintained in position but is adjustable along the sling to the desired location for contacting the load.

It will be understood that while the pad of FIGS. 1 and 3 is especially suitable for band-type slings and use with such type of sling is preferred, the clutch pad may be used with cable-type and chain-type slings. The pad of FIG. 1 may range in length from 6 inches to 500 inches or more and range in width from 1 inches to 72 inches, depending upon the size of the sling wit which the pad is to be used.

The web sections of the inner and outer sleeves are made from flexible nylon webbing, having a coating of Dupont MERLON, which provides a surface which is abrasive resistant. The coating enhances the relative sliding motion of the inner and outer sleeves. In certain instances, for example, where stress distribution is important, the MERLON is omitted so that the plys are relatively soft. In those instances, it is preferred that the inner sleeve be formed of one type of weave and the outer sleeve be formed of another type of weave. The different types of weaves enhance the slide, permitting characteristics for the plys.

The outer and inner sleeves are physically and frictionally engaged respectively with the sling and the load so that at least the outer sleeve is immoveable with respect to the load. The geometry and/or the material of the load will usually insure this condition. As explained above, however, the sleeves are moveable relative to one another under load, and this provides the clutch action explained in my co-pending application, Ser. No. 204,932.

It will be noted from inspection of FIGS. 1 to 3, the structure of the pad is symmetrical. Thus, either ply of the outer sleeve may be placed in contact with the load and this automatically puts the adjacent inner ply in contact with the sling. By having this dual work surface capability on both the inner and outer sleeves, the useful lifr of the pad is extended.

Figure 4:
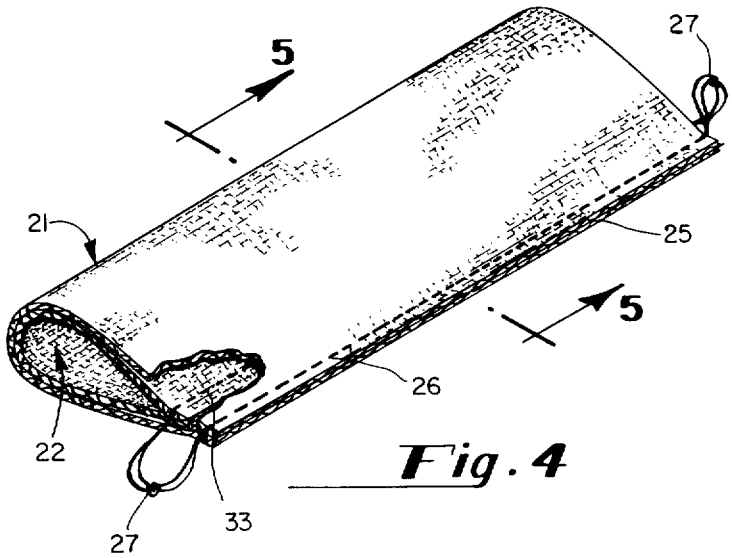
FIG. 4 is a perspective view of a pad of the invention having a relatively inexpensive construction.
Figure 5:
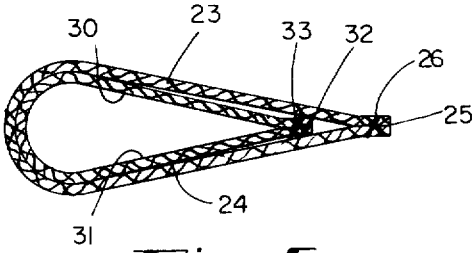
FIG. 5 is a sectional elevational view taken along the lines 4—4 of FIG. 4.

FIG. 4 illustrates another embodiment of a clutch pad which is especially advantageous in that it is relatively inexpensive to manufacture.

The clutch pad of FIG. 4 includes the outer sleeve 21 for engaging the load and inner sleeve 22 for engaging the sling. The inner sleeve is dimensioned so that it fits inside of the outer sleeve as shown. When engaged with a load and sling, the pad maitains the same out of direct contact.

The outer sleeve includes a pair of overlying ply sections 23 and 24 which are formed from a single ply folded back on itself. The plys 23 and 24 engage one another along corresponding edges as indicated in 25 and are secured together as by the stitches 26. The inner sleeve includes a pair of overlying ply sections 30 and 31 which are formed from a single ply folded back on itself. The plys 30 and 31 engage one another along the corresponding edges as indicated at 32 and secured together as by stitches 33. The inner sleeve makes a firm fit with the outer sleeve and the fit provides for the sleeves to be relatively slideably moveable in the longitudinal direction. The threads 26 and 33 are extended and tied together at 27 simply to ensure that the inner and outer sleeves remain together when not in use.

The pad of FIG. 4 is mounted on a sling by virtue of the channel formed by the inner sleeve. The pad is mounted by threading the eye of a sling through the channel and then pulling through the sling body. The inner sleeve is dimensioned so that it makes a firm fit with the sling body sufficient to maintain the pad in position but allowing the pad to be adjusted along the sling to a desired position suitable for contacting the load.

Figure 6:
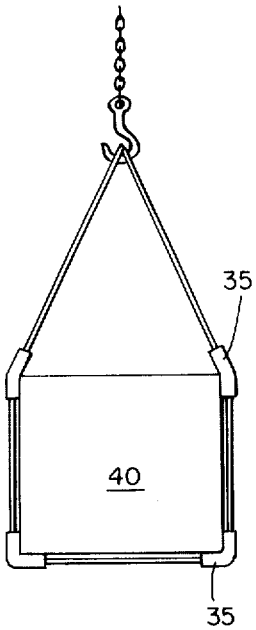
FIG. 6 is a diagrammatic view of a lifting sling equipped with the pads of FIG. 4 in position for lifting a sharp cornered load.

Normally the overall size of the pad of FIG. 2 is 6 inches to 8 inches long and about 2 inches wide, depending generally on the size of sling with which the same will be used. The pad is especially suitable for use at the sharp corners of a load and this is illustrated in FIG. 6 where the pads 35 of sling 36 are in the corner positions.

The inner and outer sleeves of the pad of FIG. 4 are made of the same material and weave and have the same coating (or non-coating) as the inner and outer sleeves of the pad of FIG. 1, and function in the same manner to obtain the desired clutch action. Also, the dual work surface feature of the sleeve in FIG. 1 applies to the sleeve of FIG. 4. As will be appreciated, the sleeves 21 and 22 have a simple straightforward construction requiring minimum material and minimum labor for fabrication and assembly and this provides a low cost pad.

Figure 1A:
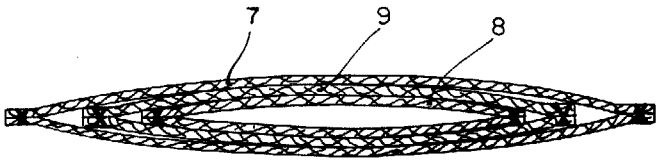

In the embodiments described in connection with FIGS. 1 and 4, the pads are constructed as by a pair of sleeves. However, the invention contemplates pads of the kind of FIGS. 1 and 4 using more than two sleeves. Thus, one or more intermediate sleeves can be inserted between the inner and outer sleeves, which, except for size have the same construction as described for the inner and outer sleeves. The cross section of a pad of the kind of FIG. 1 having an intermediate sleeve is shown in FIG. 1*a*, where the pad is comprised of outer sleeve 7, an inner sleeve 8 and the intermediate sleeve 9.

In some instances, the slings with which the pads of FIGS. 1 and 4 may be used have abnormally large eyes. To accommodate such eyes, the pad would have to be so far oversized that it would not make an acceptable fit with the sling. In those instances, therefore, the invention contemplates pad be fabricated right on the sling. Take for example, the pad of FIG. 1. The sling is disposed between the plys for the inner sleeve and the edges of the plys joined by stitches 16 and also by the stitches 17 whereby to form the inner sleeve. Next, the inner sleeve and the pad are sandwiched between the plys for the outer sleeve. The edges are then joined by the stitches 10 and 11.

Figure 7:
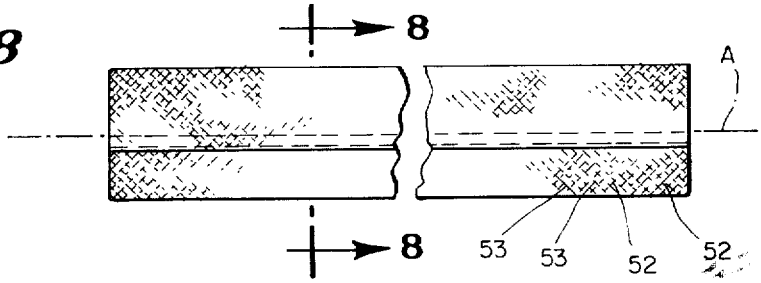
FIG. 7 is a plan view of one embodiment of a sleeve-type clutch pad formed of stretchable material arranged in a tubular form.
Figure 10:
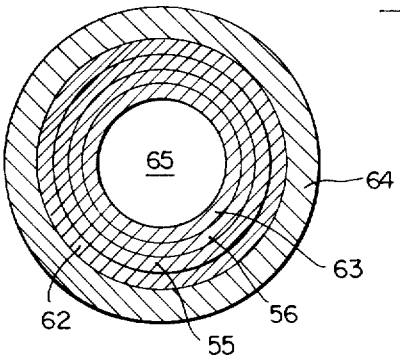
FIG. 10 is a sectional view of a sleeve-type clutch pad such as the pad of FIG. 9, the view being taken along the lines of 10—10, FIG. 9; and, FIG. 11 is an exploded somewhat diagrammatic view of another embodiment of a sleeve-type clutch pad formed of stretchable material and arranged in tubular form.

FIG. 7 illustrates a permanently attached sleeve-type clutch pad, having the stretchable and multiwork surface features.

Figure 8:
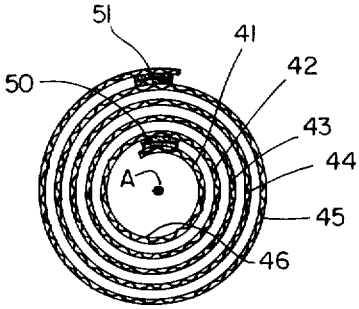
FIG. 8 is a view along the lines of 8—8 FIG. 7.

In FIG. 7 the tubular shaped clutch pad is formed by taking an elongated rectangular shaped piece of flexible, woven nylon material and winding the same over a mandrel (not shown) and into a spiral as indicated in FIG. 8. This forms a plurality of layers; namely, inner layer 41, intermediate layers, 42, 43 and 44, and outer layer 45, all generally concentric with the axis A. The inner layer 41 forms an annular channel 46 about the axis A which is adapted to accept a sling. The outer layer 45 is adapted to contact the load. When so engaged, the pad maintains the load and sling out of direct contact.

In starting the winding, an elongated strip or double sided adhesive 50 is placed along the edge of the material and the first turn of the material around the mandrel engages the adhesive strip. This secures the inner layer. The edge of the outermost layer 45 is locked by a similar adhesive strip 51. In making the winding, the flexible material is slightly stretched so that after removal from the mandrel the layers tend to shrink inwardly so that the pad contracts. Thus, the pad can be expanded or stretched radially and upon release of the stretching force, will contract to the normal position. The stretchable feature is advantageous in mounting the pad on a sling and in maintaining the pad in position.

The pad is mounted on the sling simply by stretching the pad to accommodate movement of the sling eye through the channel 46. The sling body is then pulled through the channel. When the pad is fully contracted, the diameter of the channel is smaller than the diameter of the sling so that with the contracting force the pad firmly engages the sling body. The pressure of the pad on the sling is sufficient to normally maintain the pad in position, but to permit the pad to be adjusted along the sling to a desired location for contacting the load. Also, the pad may be rotated on the sling to bring different portions in contact with the load and sling.

The material out of which the pad of FIG. 7 is formed is preferably uncoated. The material is formed in a basket weave and made of polyester yarn. The undulating characteristic of the basket weave and the low frictional coefficient of the yarn comprise the slide permitting means to insure that the layers which face one another will relatively slide under load and thus permit relative sliding motion between the inner and outer layers whereby to permit sliding motion between sling and load without the same being in contact. In this way, the pad obtains the desired clutch action.

Another important feature of the embodiment of FIG. 7 is the bias arrangement of the flexible material to enhance the clutch action. When the flexible material is cut to size, the section is severed so that the strands of yarn run diagonally to the longitudinal axis. When the material is wrapped around the mandrel each strand is formed in a spiral. This orientation is noted in FIG. 7 wherein the strands 52 run diagonally in one direction while the strands 53 run diagonally at 90°. The foregoing orientation provides for stretching of the pad layers in a direction along the axis A. This increases the ability of the intermediate layers 42, 43 and 44 to permit relative sliding motion as between the inner and outer layers 41 and 45 and therefore between the sling and the load.

In instances where it may be desirable, for example, where the sling has an extra-large eye for the pad of FIG. 7 to be formed by winding directly on the cable-type sling, the material is placed on the sling in the same way as it is placed on the mandrel as described above.

Figure 9:
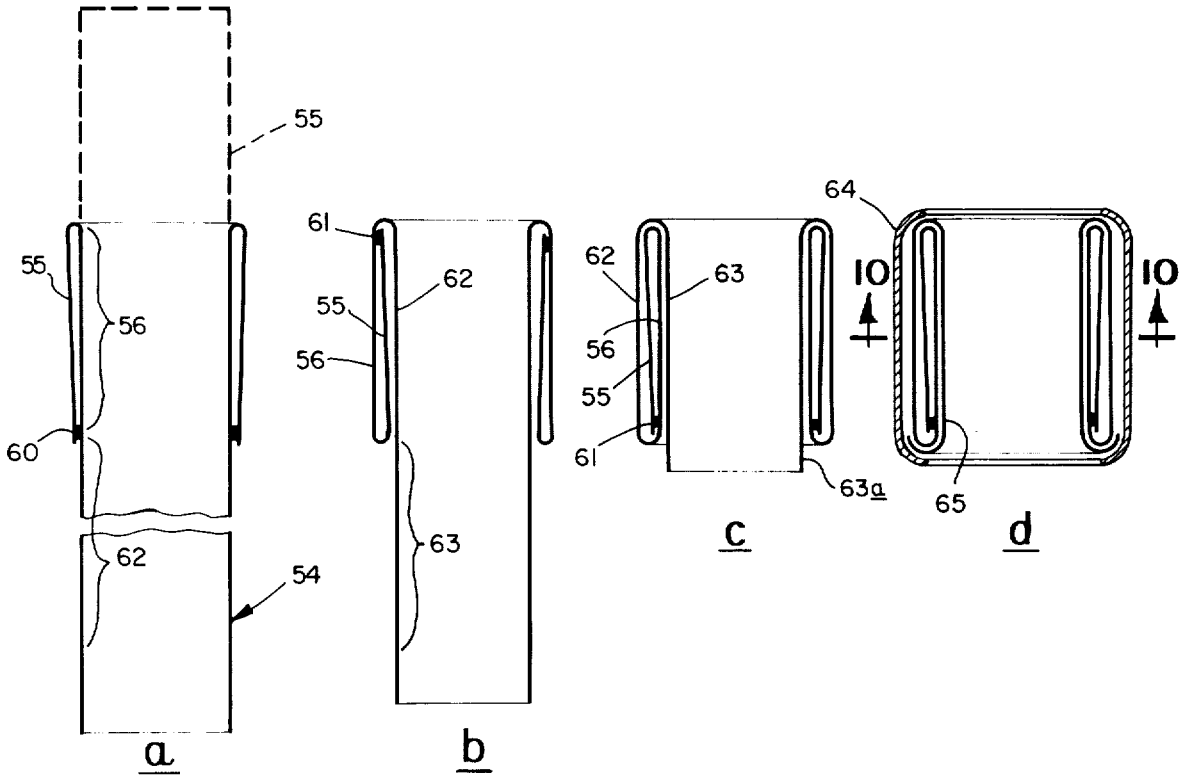
FIG. 9 is an exploded somewhat diagrammatic view of another embodiment of a sleeve-type clutch pad formed of stretchable material arranged in tubular form.

FIG. 9 diagramatically illustrates another embodiment of a stretchable multiwork surface sleeve-type clutch pad.

In FIG. 9*a*, tubular shaped piece of thin, flexible, woven nylon material 54 is placed on a mandrel (not shown). The top section 55 is folded back down on the section 56. All of the top section 55 is folded back so that there is a full length fold. The sections 55 and 56 constitute layers in the pad. Adhesive material 60 is used to join the end of the layer 55 to the layer 56. Preferably, this is a ring of double-sided adhesive tape applied to the section 56 and the end of the fold 56 is brought into contact. Next, the layers 55 and 56 are full-length folded down on the section 62 as indicated in FIG. 9*b*. The section 62 is now a layer of the pad. Next, the layers 62, 55 and 56 are full-length folded down on the section 63 and occupy the position shown in FIG. 9*c*. The section 63 now becomes a layer of the pad.

After the last full length fold has been made, the remaining section 63*a* of the layer 63 is folded back on the layer 62. When the folding process has been completed, a flexible, protective cover 64 is secured to the outer layer 62. Preferably, the cover 64 is made from flexible or elastic self-sticking material, and may be secured to the outer layer 62 by a conventional adhesive. The cover effectively becomes part of the outer layer.

The formed pad is now removed from the mandrel and is ready for mounting on a sling. The inner layer 63 forms a channel 65 to accept and grip the sling and the cover 64 is adapted to engage the load. The pad maintains the load and sling out of direct contact. The pad is mounted and positioned on a sling similarly as described for the pad of FIG. 7.

The diameter of the mandrel and the diameter of the nylon material 54 are chosen so that when the material is placed on the mandrel it is slightly stretched. Thus, when the pad is removed the various layers will tend to shrink inwardly and cause the pad to contract. The pad is dimensioned so that the diameter of the channel 65 is slightly smaller than the diameter of the sling and with the contracting force, the pad makes a firm, but sliding grip similarly as the pad of FIG. 7. Also, the pad may be rotated to bring different portions into contact with load and sling.

The nylon material 54, out of the pad of FIG. 9 is formed, is preferably uncoated. The basket weave and the nylon material comprise the slide, permitting means so that the surfaces of the layers which face one another under lifting conditions, are capable of relative sliding motion to produce the clutch action previously referred to.

It will be understood that the length of the material 54 can be chosen so that additional full length folds may be made and thus increase the number of layers in the pad. The foregoing, however, will suffice for descriptive purposes.

The invention contemplates that the material 54 be comprised of a plurality of tubular pieces rather than a single piece, as described above. This provides a thicker pad for heavy duty applications, and enhances the clutching action.

Figure 11:
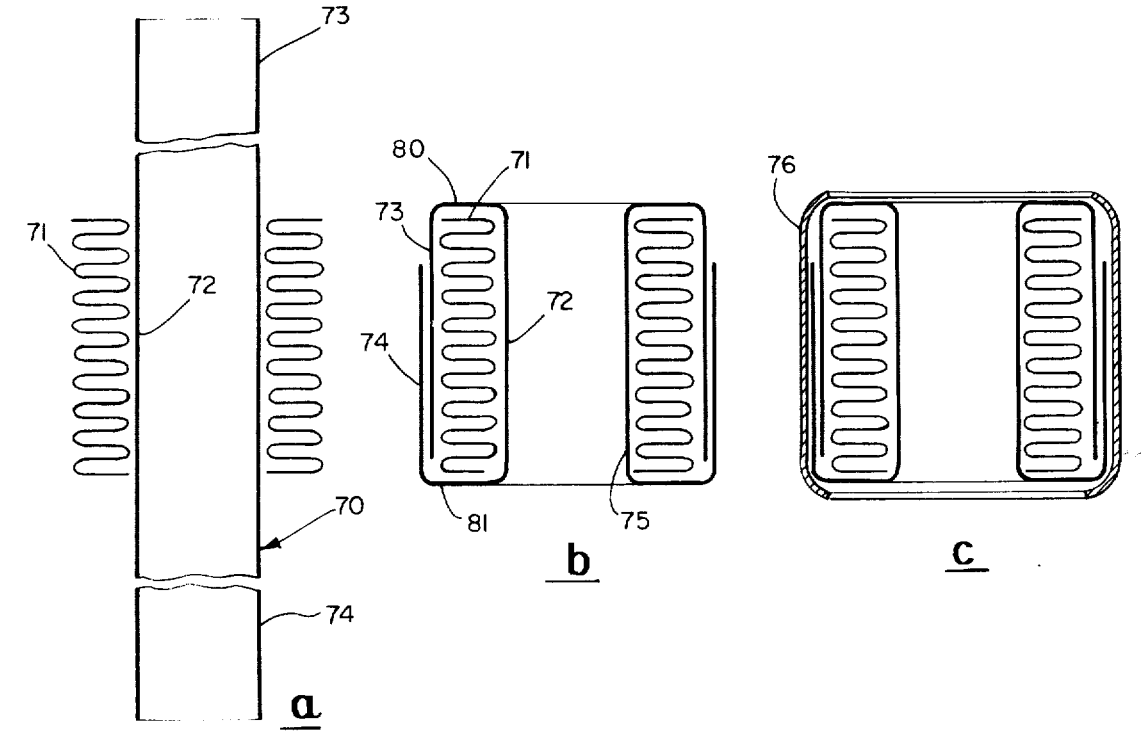

FIG. 11 diagramatically illustrates another embodiment of a stretchable, multiwork surface sleeve-type clutch pad.

In FIG. 11*a*, a tubular shaped piece of thin, flexible woven nylon material 70 is placed over a mandrel (not shown). The material has central section 72 and outboard sections 73 and 74. Then, another piece of the same kind of material is placed over the webbing 70 and worked down, in bellows-like form, as indicated at 71. For working the webbing into the bellows form, a fixture is provided to hold and support the bottom of the webbing. The bellows is positioned on the webbing so that it covers the central or intermediate section 72. While I've shown the folds of the bellows as being separated, this has been done for descriptive purposes only, and on actual pad, the folds of the bellows are closely packed together in layers.

After the bellows has been formed, the outboard section 73 is folded down over the bellows and then the outboard section 73 is folded up over the section 72, as indicated at FIG. 11*b*. Preferably, prior to the folding of the section 74, the outer part of the section 73 is sprayed with an adhesive, which acts to bind the sections 73 and 74 together. A typical adhesive is polyurethane. The central section 72 forms an inner layer. The inner layer forms a channel 75 for accepting the sling. The sections 73 and 74 form the outer layer. The various folds for the bellows 71 form an intermediate layer means.

After the outboard sections 73 and 74 have been put into place, a flexible protective cover 76 is secured to the outer layer. The cover becomes a part of the outer layer. Preferably, the cover is made from the same material as the cover 64 in FIG. 9*d*.

The pad is then removed from the mandrel and is ready for placing on a sling. The diameter of the mandrel and the diameter of the material 70 are chosen so that the material is slightly stretched when placed over the mandrel. The folding of the outboard sections 73 and 74 over the bellows 71 also causes stretching of the material, particularly at the ends 80 and 81. Thus, when the pad is taken off the mandrel, the layers will tend to shrink inwardly and cause the pad to contract. The pad is dimensioned so that the diameter of the channel 75 is slightly smaller than the diameter of the sling, and with the contracting force, the pad makes a firm, but sliding grip. The pad is mounted and positioned on the sling similarly as described for the pad of FIG. 7.

When the outboard sections 73 and 74 are folded over the bellows 71 the folds of the bellows tend to become oriented at an acute angle to the axis of the channel 75 and thus are layered radially and extend circumferentially. In some instances, the folds of the bellows as they are pushed inwardly take a random orientation and are interleaved with adjacent random oriented folds. Nevertheless, such folds become layers stacked in a radial directon and extending circumferentially. In either case, the orientation helps to provide the relative sliding motion between the folds or layers of the bellows.

The material 70 and 71 is made from uncoated nylon formed as by a basket weave. This comprises slide permitting means to insure that the folds or layers of the bellows which face each other will slide relative to each other and also retrieve to the inside facing surfaces of the inner and outer layers. This permits relative sliding motion between the inner and outer layers and hence between the sling and load without the same being in direct contact. The desired clutch action is obtained in this way. Similarly as the piece 54 of FIG. 9, the part 70 can be formed of a plurality of pieces of nylon tubing.

I claim:

1. A clutch pad to be mounted on a sling in engagement with a load to be lifted by the sling, the pad permitting relative sliding motion between the load and sling, the pad comprising:

an outer sleeve including a pair of over-lying, generally flat ply sections fixedly connected together, either of the plys being adapted to be placed in contact with the load to be lifted;

an inner sleeve disposed inside the outer sleeve and including a pair of carrying, generally flat ply sections fixedly connected together, the last said plys being adapted to receive a sling there-beween and the inner and outer sleeves being slidable relative to each other; and on the surfaces of the plys of the inner and outer sleeves which face one another, slide permitting means operative when the sling and load are in lifting condition to permit relative sliding motion between the inner and outer sleeves and thereby provide for relative sliding motion between the load and the sling without the load and sling being in direct contact.

2. A clutch pad to be mounted on a sling in engagement with a load to be lifted by the sling, the pad permitting relative sliding motion between the load and sling, the pad comprising:

an outer sleeve including a pair of over-lying, generally flat ply sectionsm fixedly connected together, either of the plys being adapted to be placed in contact with the load to be lifted;

an inner sleeve inside of the outer sleeve and including a pair of overlying, generally flat ply sections fixedly connected together, the last said plys being adapted to receive a sling there-between and the inner and outer sleeves being slideable relative to each other;

at least one intermediate sleeve disposed between the inner and outer sleeves and including a pair of overlying, generally flat ply sections fixedly connected together and the intermediate sleeve being slideable relative to the inner and outer sleeves; and on the surfaces of the plys of the inner, outer and intermediate sleeves which face one another, slide permitting means operative when the sling and load are in lifting condition to permit relative sliding motion between the inner and outer sleeves and thereby provide for relative sliding motion between the load and the sling without the load and sling being in direct contact.

3. In combination a clutch pad and a sling, the pad being for use in engaging a load to be lifted by the sling, the pad permitting relative sliding motion between the load and sling, the pad comprising:

an outer sleeve including a pair of over-lying, generally flat ply sections fixedly connected together, either of the plys being adapted to be placed in contact with the load to be lifted;

an inner surface disposed inside the outer sleeve and including a pair of overlying, generally flat ply sections fixedly connected together, the last said plys having the sling there-between and the inner and outer sleeves being slideable relative to each other; and on the surfaces of the plys of the inner and outer sleeves which face one another, slide permitting means operative when the sling and load are in lifting condition to permit relative sliding motion between the inner and outer sleeves and thereby provide for relative sliding motion between the load and the sing without the load and sling being in direct contact.

4. A clutch pad to be mounted on a sling in engagement with a load to be lifted by the sling, the pad permitting relative sliding motion between the load and sling, the pad comprising:

an outer sleeve including a pair of over-lying, generally flat ply sections, the corresponding opposite edges of which are fixedly connected together, either of the plys being adapted to be placed in contact with the load to be lifted;

an inner sleeve inside of the outer sleeve and including a pair of overlying, generally flat ply sections the corresponding opposite edges of which are fixedly connected together, the last said plys being adapted to receive a sling there-between and the inner and outer sleeves being slideable relative to each other;

at least one intermediate sleeve disposed between the inner and outer sleeves and including a pair of overlying, generally flat ply sections the corresponding opposite edges of which are fixedly connected together and the intermediate sleeve being slideable relative to the inner and outer sleeves; and on the surfaces of the plys of the inner, outer and intermediate sleeves which face one another, slide permitting means operative when the sling and load are in lifting condition to permit relative sliding motion between the inner and outer sleeves and thereby provide for relative sliding motion between the load and the sling without the load and sling being in direct contact.

5. In combination a clutch pad and a sling, the pad being for use in engaging a load to be lifted by the sling, the pad permitting relative sliding motion between the load and sling, the pad comprising:

an outer sleeve including a pair of over-lying, generally flat ply sections, the corresponding opposite edges of which are fixedly connected together, either of the plys being adapted to be placed in contact with the load to be lifted;

an inner sleeve disposed inside the outer sleeve and including a pair of overlying, generally flat ply sections the corresponding opposite edges of which are fixedly connected together, the last said plys having the sling there-between and the inner and outer sleeves being slideable relative to each other; and on the surfaces of the plys of the inner and outer sleeves which face one another, slide permitting means operative when the sling and load are in lifting condition to permit relative sliding motion between the inner and outer sleeves and thereby provide for relative sliding motion between the load and the sling without the load and sling being in direct contact.

6. In combination a clutch pad and a sling, the pad being for use in engaging a load to be lifted by the sling, the pad permitting relative sliding motion between the load and sling, the pad comprising:

an outer sleeve including a pair of over-lying, generally flat ply sections, the corresponding opposite edges of which are fixedly connected together, either of the plys being adapted to be placed in contact with the load to be lifted;

an inner sleeve inside of the outer sleeve and indicating a pair of overlying, generally flat ply sections the corresponding opposite edges of which are fixedly connected together, the last said plys having the sling there-between and the inner and outer sleeves being slideable relative to each other;

at least one intermediate sleeve disposed between the inner and outer sleeves and including a pair of overlying, generally flat ply sections the corresponding opposite edges of which are fixedly connected together, and the intermediate sleeve being slidable relative to the inner and outer sleeves; and on the surfaces of the plys of the inner, outer and intermediate sleeves which face one another, slide permitting means operative when the sling and load are in lifting condition to permit relative sliding motion between the inner and outer sleeves and thereby provide for relative sliding motion between the load and the sling without the load and sling being in direct contact.

7. A clutch pad to be mounted on a sling in engagement with a load to be lifted by the sling, the pad permitting relative sliding motion between the load and the sling, the pad comprising an outer sleeve including a pair of overlying ply sections formed from a single section folded back on itself, the pair engaging one another and being fixedly connected together along the corresponding edges opposite the fold, either of the plys being adapted to be placed in contact with the load to be lifted;

an inner sleeve disposed inside of the outer sleeve and including a pair of overlying ply sections formed from a single section folded back on itself, the pair engaging one another and being fixedly connected together along the corresponding edges opposite the fold and being adapted to receive a sling there between and the inner and outer sleeves being slideable relative to each other; and on the surfaces of the plys of the inner and outer sleeves which face one another, slide permitting means operative when the sling and load are in lifting condition to permit relative sliding motion between the inner and outer sleeves and thereby provide for relative sliding motion between the load and the sling without the load and sling being in direct contact.

8. A construction in accordance with claim 7 wherein said slide permitting means is constructed by that the plys of the other sleeve are nylon weave of one type and the plys of the inner sleeve are also nylon weave of a different type.

9. A construction in accordance with claim 7 wherein said slide permitting means includes an abrasive resistant coating on the webs of the inner and outer sleeves.

10. A tubular shaped clutch pad to be mounted on a sling in engagement with a load to be lifted by the sling, the pad permitting relative sliding motion between the load and the sling, the pad comprising:

a tubular shaped outer layer made of flexible, stretchable material, the outer layer being adapted to be placed in contact with the load to be lifted;

a tubular shaped inner layer made of flexible, stretchable material, the inner layer forming an annular channel for accepting the sling.

a plurality of intermediate layers disposed between the inner and outer layers and made of flexible, stretchable material; and on the surfaces of the layers which face one another, slide permitting means operative when the sling and load are in lifting condition to permit relative sliding motion between the facing layers and thereby permit relative sliding motion between the inner and outer layers whereby to permit relative sliding motion between sling and load without the load and sling being in contact.

11. A tubular shaped clutch pad to be mounted on a sling in engagement with a load to be lifted by the sling, the pad permitting relative sliding motion between the load and the sling, the pad comprising:

a tubular shaped outer layer made of flexible, stretchable material, the outer layer being adapted to be placed in contact with the load to be lifted;

a tubular shaped inner layer made of flexible, stretchable material, the inner layer forming an annular channel for accepting the sling;

a plurality of intermediate layers disposed between the inner and outer layers and made of flexible, stretchable material;

on the surfaces of the layers which face one another, slide permitting means operative when the sling and load are in lifting condition to permit relative sliding motion between the facing layers and thereby permit relative sliding motion between the inner and outer layers whereby to permit relative sliding motion between sling and load without the load and sling being in contact; and the stretchable, resilient characteristic of said layers providing for the channel to be manually radially expandable whereby the pad can be moved over the eye of and onto the body of a sling and further providing that when on the sling and with the expanding force moved, the resiliency causing the pad to contract and grip the sling.

12. A tubular shaped clutch pad to be mounted on a sling in engagement with the load to be lifted by the sling, the pad permitting relative sliding motion between the load and the sling, the pad comprising:

an elongated piece of flexible material formed in a basket weave and wound up in a spiral around an axis to form a plurality of layers including an outer layer, an inner layer and a plurality of intermediate layers disposed between the inner and outer layers, the outer layer being adapted to be placed in contact with the load to be lifted and the inner layer forming an annular channel about the axis and the channel being adapted to accept the sling whereby the inner layer contacts the sling and each strand in the material making up said weave being wound in a spiral with respect to said axis, the orientation permitting the layers to stretch in a direction along the axis; and on the surfaces of the layers which face one another slide permitting means operative when the sling and load are in lifting condition to permit relative sliding motion between facing layers and thereby permit relative sliding motion between the inner and outer layers whereby to permit relative sliding motion between the sling and the load without the load and the sling being in direct contact.

13. A tubular shaped clutch pad to be mounted on a sling in engagement with the load to be lifted by the sling, the pad permitting relative sliding motion between the load and the sling, the pad comprising:

an outer layer of tubular shape;

an inner layer of tubular shape;

a plurality of intermediate layers each of generally tubular shape and disposed between the inner and outer layers, said inner, outer and intermediate layers being formed from flexible, stretchable material folded back a plurality of whole-length folds;

means forming a flexible, protective cover secured to the outer layer, the inner layer being formed in an annular channel about an axis and the channel being adapted to accept the sling whereby the inner layer contacts the sling and the cover being adapted to be placed in contact with the load to be lifted; and on the surfaces of the layers which face one another, slide permitting means operative when the sling and load are in lifting condition to permit relative sliding motion between the facing layers and thereby permit relative sliding motion between the inner and outer layers whereby to permit relative sliding motion between the sling and the load without the load and the sling being in direct contact.

14. A tubular shaped clutch pad to be mounted on sling in engagement with the load to be lifted by the sling, the pad to permit relative sliding motion between the load and the sling, the pad comprising:

an inner layer of tubular shape;

an outer layer of tubular shape spaced from the inner layer, the layers being formed by that a flexible, stretchable tubular webbing has two spaced apart outboard sections and a central section intermediate to same, the two outboard sections being respectively folded back in overlapped generally parallel relationship to the central section, the overlapped sections forming the outer layer and the central section forming the inner layer;

intermediate layer means disposed between the inner and outer layers, the intermediate layer means comprising a plurality of circumferentially extending layers formed from the folds of a flexible, stretchable tubular webbing arranged in bellows;

means forming a flexible, protective cover secured to the outer layer, the inner layer being formed in an annular channel about an axis and the channel being adapted to accept the sling whereby the inner layer contacts the sling and cover being adapted to be placed in contact with the load to be lifted; and on the surfaces of the inside and outside layers which face the folds of the intermediate layer means and on the facing surfaces of the folds of the intermediate layer means, slide permitting means operative when the sling and load are in lifting condition to permit relative sliding motion between the facing surfaces whereby to provide for relative sliding motion between the inner and outer layers and thereby permit relative sliding motion between the sling and the load without the sling and load being in direct contact.

15. A sleeve-type clutch pad to be mounted on a sling in engagement with a load to be lifted by the sling, the pad permitting relative sliding motion between the load and sling, the pad comprising:

an outer sleeve including ply means connected together and arranged in generally annular form, the ply means being adapted to be placed in contact with the load to be lifted;

an inner sleeve disposed inside the outer sleeve and including ply means connected together and arranged in generally annular form for receiving and engaging the sling; and slide permitting means on the surfaces of the inner and outer sleeves which face one another and operative when the sling and load are in lifting condition to permit relative sliding motion between the inner and outer sleeve and thereby provide for relative sliding motion between the load and the sling without the load and sling being in direct contact.

16. A sleeve-type clutch pad to be mounted on a sling in engagement with a load to be lifted by the sling, the pad permitting relative sliding motion between the load and sling, the pad comprising;

an outer sleeve including ply means connected together and arranged in generally annular form, the ply means being adapted to be placed in contact with the load to be lifted;

an inner sleeve inside of the outer sleeve and including ply means connected together and arranged in generally annular form for receiving and engaging the sling; and at least one slide permitting intermediate sleeve disposed between the inner and outer sleeves, the intermediate sleeve including ply means connected together and arranged in generally annular form and the intermediate sleeve and the inner and outer sleeves being slidable relative to one another when the sling and load are in lifting condition to permit relative sliding motion between the inner and outer sleeves and thereby provide for relative sliding motion between the load and the sling without the load and sling being in direct contact.

* * * * *